United States Patent [19]

Sharma

[11] Patent Number: 4,680,055

[45] Date of Patent: Jul. 14, 1987

[54] METALLOTHERMIC REDUCTION OF RARE EARTH CHLORIDES

[75] Inventor: Ram A. Sharma, Troy, Mich.

[73] Assignee: General Motors Corporation, Detroit, Mich.

[21] Appl. No.: 840,762

[22] Filed: Mar. 18, 1986

[51] Int. Cl.[4] ..... C22B 59/00; C01F 11/24

[52] U.S. Cl. ..... 75/84.5; 75/66; 75/67 R; 423/497

[58] Field of Search ..... 75/66, 67 R, 84.5; 423/497, 499, 491

[56] References Cited

U.S. PATENT DOCUMENTS

| | | | |
|---|---|---|---|
| 1,437,984 | 12/1922 | Marden | 75/84.1 R |
| 1,682,846 | 9/1928 | Kremers | 420/416 |
| 2,714,554 | 8/1955 | Spedding et al. | 75/84.5 |
| 2,852,363 | 9/1958 | Adams et al. | 75/66 |
| 2,950,962 | 8/1960 | Carlson et al. | 75/84.4 |
| 3,000,726 | 9/1961 | Spedding et al. | 75/84.1 R |
| 3,014,797 | 12/1961 | Elisher | 75/62 |
| 3,265,492 | 8/1966 | Juckniess | 420/402 |
| 3,625,779 | 12/1971 | Cech | 148/101 |
| 3,748,193 | 7/1973 | Cech | 148/101 |
| 3,883,346 | 5/1975 | Martin | 75/0.5 B A |
| 3,928,089 | 12/1975 | Cech | 148/105 |
| 4,496,395 | 1/1985 | Crout | 420/416 |
| 4,578,242 | 3/1986 | Sharma | 420/83 |

FOREIGN PATENT DOCUMENTS

| | | | |
|---|---|---|---|
| 10867 | of 1901 | United Kingdom | 75/84.5 |
| 627286 | 8/1949 | United Kingdom | 75/84.5 |

OTHER PUBLICATIONS

"Rare Earth Elements and Metals", Van Nostrand's Scientific Encyclopedia, 5th Ed., 1976, pp. 1886–1890.

Kirk-Othmer Encyclopedia of Chemical Technology, 3rd ed., v 19, 1982, pp. 846–850.

*Primary Examiner*—John F. Terapane
*Assistant Examiner*—Eric Jorgensen
*Attorney, Agent, or Firm*—Elizabeth F. Harasek

[57] ABSTRACT

Rare earth chlorides and oxychlorides can be reduced to substantially pure rare earth metals by a novel, high yield, metallothermic process. The rare earth chloride feedstock is dispersed in a vessel containing a suitable molten chloride salt bath and a molten metal collection pool. Enough sodium, potassium and/or calcium is added to the bath to produce a stoichiometric excess of calcium metal with respect to the rare earth. The bath is stirred such that the calcium metal reduces the rare earth feedstock. Stirring is stopped and the reduced rare earth metal is collected in the metal pool in the reaction vessel.

15 Claims, 4 Drawing Figures

METALLOTHERMIC REDUCTION OF RARE EARTH CHLORIDES

This invention relates to a novel metallothermic process for the direct reduction of rare-earth chlorides, oxychlorides or combinations thereof to rare earth metal. The method has particular application to low cost production of neodymium metal for use in neodymium-iron-boron magnets.

BACKGROUND

In the past, the strongest commercially produced permanent magnets were made from sintered powders of $SmCo_5$. Recently, even stronger magnets have been made based on the light rare earth elements, preferably neodymium and praseodymium, iron and boron. These magnets contain a $RE_2Fe_{14}B$ phase. These magnetic compositions and methods of processing them to make magnets are described in U.S. Pat. No. 4,496,395; U.S. Ser. Nos. 414,936 (filed 9/3/82); 508,266 (filed 6/24/83) now abandoned; and 544,728 (filed 10/26/83) to Croat; 520,170 (filed 8/4/83) to Lee; and 492,629 (filed 5/9/83) to Croat and Lee, all assigned to General Motors Corporation.

The rare earth (RE) elements include atomic numbers 57 to 71 of the Periodic Chart as well as yttrium, atomic number 39. Important sources of the rare earths are bastnaesite and monazite ores. Mixtures of the rare earths can be extracted from the ores by several well known beneficiating techniques. The rare earths can then be separated from one another by such conventional processes as elution and liquid-liquid extraction.

Once the rare earth metals are separated from one another, they must be reduced from their compounds to the respective metals in relatively pure form (95 atomic percent or purer depending on the contaminants) to be useful for permanent magnets. In the past, this final reduction was both complicated and expensive, adding substantially to the cost of rare earth metals.

The first reduction of rare earth halides was accomplished by their reaction with more electropositive metals such as calcium, sodium, lithium and potassium. However, the rare earth metals have a great affinity for such elements as oxygen, sulfur, nitrogen, carbon, silicon, boron, phosphorous and hydrogen. Thus the reduced metals so produced were highly contaminated with very stable compounds of the rare earths and these elements. The yields of these reactions were also very low (about 25 percent) and the metal existed as small nuggets surrounded by alkali chloride slag. A discussion of early rare earth chloride reduction appears at pages 846–850, Kirk-Othmer Encyclopedia of Chemical Technology, 3rd Ed., Volume 19, 1982.

Today, both electrolytic and metallothermic (non-electrolytic) processes are employed to commercially reduce rare earth compounds to rare earth metals pure enough for use in industry. The electrolytic processes include (1) decomposition of anhydrous rare earth chlorides dissolved in molten alkali or alkaline earth salts, and (2) decomposition of rare earth oxides dissolved in molten rare earth fluoride salts.

Disadvantages of both electrolytic processes include the use of expensive electrodes which are eventually consumed, the use of anhydrous chloride or fluoride salts to prevent the formation of undesirable RE-oxy salts (NdOCl, e.g.), high temperature cell operation (generally greater than 1000° C.), low current efficiencies resulting in high power costs, low yield of metal from the rare earth salt (generally 40 percent or less of the metal in the salt can be recovered). The RE-fluoride reduction process requires careful control of a temperature gradient in the electrolytic salt cell to cause solidification of rare earth metal nodules. An advantage of electrolytic processes is that they can be made to run continuously if provision is made to tap the reduced metal and to refortify the salt bath.

The most common metallothermic (non-electrolytic) processes are (1) reduction of RE-fluorides with calcium metal (the calciothermic process), and (2) reduction-diffusion of RE-oxide with calcium hydride or calcium metal. Disadvantages are that both are batch processes, they must be conducted in a non-oxidizing atmosphere, and they are energy intensive. In the case of reduction-diffusion, the product is a powder which must be washed repeatedly to purify it before use. Both processes involve many steps. One advantage of metallothermic reduction is that the yield of metal from the oxide or fluoride is generally better than 90 percent. Neither of these metallothermic reduction processes showed much promise for reducing the cost or increasing the availability of magnet-grade rare earth metals.

U.S. Ser. Nos. 627,736 (now abandoned) and U.S. Pat. No. 4,578,242, issued Mar. 25, 1986 both to Sharma filed July 3, 1984 and also assigned to General Motors Corporation are incorporated herein by reference. These applications relate to new, high-yield methods of metallothermically reducing rare earth oxides. However, in some circumstances it may be preferable to use RE chloride as feedstock for a rare earth reduction process. Therefore, the principal object of this invention is the creation of an improved method of metallothermically reducing rare earth chlorides.

BRIEF SUMMARY

This and other objects may be accomplished in accordance with a preferred practice of the invention as follows.

A reaction vessel is provided which can be heated to desired temperatures by electrical resistance heaters or some other heating means. The vessel body is preferably made of a metal or refractory material that is either substantially inert or innocuous to the molten reaction constituents.

Each variation of the subject method entails mixing the starting RE chloride compound in a molten bath of Group I and/or Group II chloride salt(s). How the composition of the salt bath is preferably adjusted to accommodate the RE-containing feedstock and reducing metal(s) will be described hereinafter. A molten metal collection pool is formed in the reaction vessel that has approximately the same specific gravity as the reduced rare earth metal. The pool may comprise such metals as iron, zinc, rare earth metals, aluminum, etc. Near eutectic combinations of metals are preferred so that the melting temperature of the pool is lower than the sublimation temperature of the reducing metal(s). When the reduced RE metal is used to make RE-Fe-B magnets, for example, a near eutectic Nd-Fe collection pool is very practical. Preferred collection pool compositions will also be described hereinafter.

This invention relates particularly to the reduction of RE chlorides by the reactions $$RECl_3 + 3M \rightarrow RE + 3MCl$$

and $$2RECl_3+3M'\rightarrow 2RE+3MCl_2$$

where RE is one or more rare earth elements having a +3 oxidation state in the chloride; M is a Group I metal, preferably sodium; M' is a Group II metal, preferably calcium. Where the RE chloride has a different oxidation state ($SmCl_2$, e.g.) the amount of reducing metal should be adjusted as required to balance the equation. Mixtures of Group I and II reducing metals may be used causing both reactions set forth above to run concurrently.

As an example, where the RE is neodymium and the reducing metal is sodium, the reaction would be $$NdCl_3+3Na\rightarrow Nd+3NaCl.$$

Where the RE is Nd and the reducing metal is calcium, the reaction would be $$2NdCl_3+3Ca\rightarrow 2Nd+3CaCl_2.$$

This invention further relates to the reduction of RE oxychlorides with Ca metal by the reaction $$2REOCl+3Ca\rightarrow 2RE+2CaO+CaCl_2$$

where RE is one or more rare earth elements having a +3 oxidation state in the oxychloride.

As an example, where the RE is neodymium the reaction would be $$2NdOCl+3Ca\rightarrow 2Nd+2CaO+CaCl_2.$$

The equations set forth above describe dominant reactions which take place in my metallothermic reduction of RE chlorides and/or oxychlorides. Both RE chlorides and oxychlorides can be reduced in the same reaction vessel at the same time if enough calcium is present. I believe that many other intermediate reactions probably occur in a reaction vessel as my method is practiced but these need not be fully characterized nor understood to practice the subject invention.

To run a RE reduction reaction, the reaction vessel is heated to a temperature above the melting point of the constituents but preferably below the vaporization temperature of the reducing metal. The molten constituents are rapidly stirred in the vessel to keep them in contact with one another as the reaction progresses. Prior art processes yielded highly contaminated nodules of RE metal or salt/powder mixtures. The stirring of the molten salt bath and metal collection pool of my method results in the reduced RE metal being attracted to and ultimately collected in the pool.

The reduced rare earth metal and collecting pool have a density over about 7 grams/cc while the density of the salt bath is about 2–4 grams/cc. Therefore, when stirring is stopped, the reduced metal is recovered in a clean layer at the bottom of the reaction vessel. This layer may be tapped while molten or separated from the salt layer after it solidifies.

The subject method provides many advantages over prior art methods. It is preferably carried out at a relatively low temperature of about 700° C., particularly where the rare earth metal is recovered as a constituent of a eutectic. Energy consumption is low because the method is not electrolytic. It is preferably carried out at atmospheric pressure. The method can be practiced as either a batch or a continuous process, and the by-products such as NaCl and $CaCl_2$ are easily disposed of. Because of the high purity of the rare earth metals produced (i.e., the absence of any significant amount of oxide, oxychloride or other such impurities), they may be alloyed in the reaction vessel or later for use in RE-Fe based magnets without additional, expensive purification treatments.

BRIEF DESCRIPTION OF DRAWINGS

The objects and advantages of the invention will be better understood in view of the following detailed description and the figures in which.

DETAILED DESCRIPTION

Figure 1:
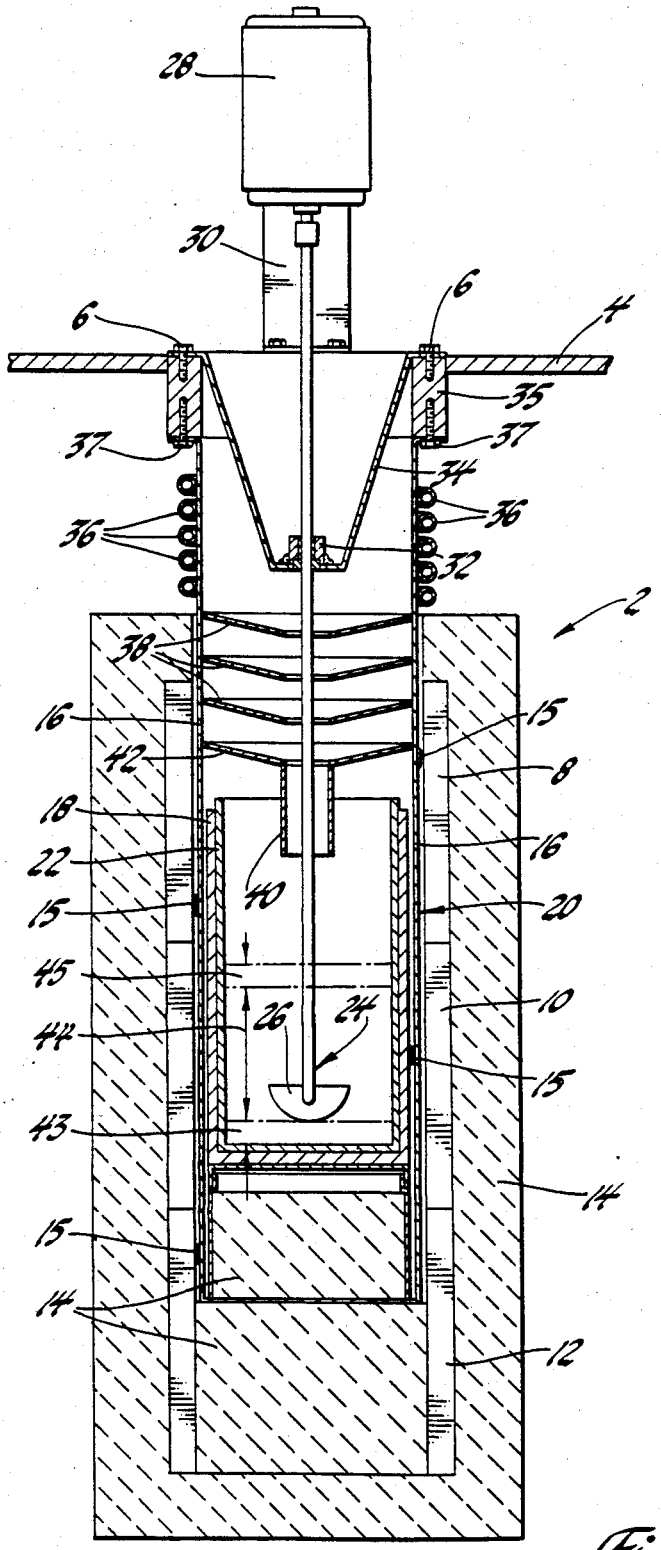
FIG. 1 is a schematic of an apparatus suitable for carrying out the subject method of reducing RE-chlorides to RE metals.

This invention relates to an improved method of reducing compounds of rare earth elements to the metals. The rare earth metals include elements 57 through 71 of the periodic chart (scandium, lanthanum, cerium, praseodymium, neodymium, samarium, europium, gadolinium, terbium, dysprosium, holmium, erbium, thulium, ytterbium, lutetium) and atomic number 39, yttrium. The chlorides of the rare earths are generally colored powders produced in the metal's separation process or by transformation of the oxide to the chloride. Herein, the term "light rare earth" refers to the elements La, Ce, Pr and Nd or mixtures thereof or mischmetals consisting predominantly thereof.

In the practice of this invention, anhydrous RE-chlorides can generally be used as received from the separator. If any substantial amount of oxychloride and/or moisture is present, calcium metal should be used as the reductant.

Unalloyed Nd metal has a melting temperature of about 1025° C. The other rare earth metals also have high melting points. If one wanted to run the subject reaction at such temperatures, it would be possible to do so and obtain pure metal at high yields. However, it is preferred to add amounts of other metals such as iron, zinc, aluminum or other non-rare earth metals to the reduction vessel in order to form an alloy with the recovered rare earth metal that is lower melting. For example, iron forms a low melting eutectic with neodymium (11.5 weight percent Fe; m.p. about 640° C.) as does zinc (11.9 weight percent Zn, m.p. about 630° C.). A near eutectic collection pool of iron and rare earth is very efficient for aggregation reduced rare earth elements. A Nd-Fe eutectic alloy may be directly alloyed with additional iron and boron to make magnets having the optimum $Nd_2Fe_{14}B$ magnetic phase described in the U.S. Ser. Nos. to Croat and Lee cited above. Metals may be added to the reaction vessel as needed to maintain a desired composition in the collection pool.

If it is preferred to lower the melting point of the recovered rare earth metal but not retain the metal added to do so, a metal with a boiling point much lower than the boiling point of the recovered rare earth can be added to the reaction vessel. For example, Zn boils at 907° C. and Nd boils at 3150° C. A low-melting metal such as zinc can be readily separated from recovered rare earth metal by simple distillation.

Materials used for reaction vessels should be chosen carefully because of the corrosive nature of molten rare earth metals, particularly rare earth metals retained in a salt flux environment. Yttria lined alumina may be acceptable. It is also possible to use a vessel made of a substantially inert metal such as tantalum or a consumable but innocuous metal such as iron. An iron vessel could be used to contain reduced RE metal and then be alloyed with the RE recovered in it for use in magnets.

In accordance with a preferred practice of this invention, I have discovered a new method of using Group I and II metals, particularly sodium, potassium, and calcium, to reduce rare earth chlorides. The reducing metal can be added directly to the reaction vessel to effect reduction of the rare earth chloride by the reaction $$xRECl_n + yM \rightarrow xRE + yMCl$$

as set forth above. Where the $CaCl_2$ content of the bath is maintained above about 70 percent, Na or K may be added to produce Ca metal in the reaction vessel by the reaction $$CaCl_2 + 2M \rightarrow 2MCl + Ca.$$

Where any substantial amount of oxychloride is present, calcium must be present either by direct addition or exchange reaction with sodium since the oxychloride is not directly reduced by Group I metals. The reducing metal is rapidly stirred with the rare earth chloride and in the salt bath to keep all constituents in physical contact with one another.

The most preferred range of operating temperatures is between about 650° C. and 850° C. At such temperatures the loss of reducing metal is not a serious problem nor is wear on the reaction vessel. This temperature range is suitable for reducing $NdCl_3$ to Nd metal because the Nd-Fe and Nd-Zn eutectic temperatures are below 700° C. Similarly, the melting temperatures of RE chlorides and oxychlorides are reduced when they are dispersed in chloride salts of sodium, calcium, potassium, etc. Higher operating temperatures are acceptable, but there are many advantages of operating at lower temperatures. For good separation of reduced metal from the flux, the reaction temperature must be above the melting point of the reduced metal or the melting point of the reduced metal alloyed or coreduced with another metal.

It is important to agitate the constituents during the reduction reaction. Agitation such as rapid stirring causes the metal from the collection pool to mix with the salt bath. The metal from the pool agglomerates with the RE metal created by the reduction reaction. When agitation is stopped, the relatively dense RE metals become part of the collection pool and settle below the salt bath and any unreacted reducing metal in the reaction vessel. There the rare earth metals can be tapped while molten or removed after solidification.

Table I shows the molecular weight (m.w.), density (sp. g.), melting point (m.p.) and boiling point (b.p.) for selected elements used in the subject invention.

TABLE I

| | (@25° C.) m.w. | (@25° C.) sp. g. | m.p. (°C.) | b.p. (°C.) |
|---|---|---|---|---|
| La | 138.91 | 6.14 | 921 | 3457 |
| $LaCl_3$ | 245.27 | 3.842 | 860 | >1000 |
| Nd | 144.24 | 7.004 | 1024 | 3300 |
| $NdCl_3$ | 250.60 | 4.134 | 784 | 1600 |
| Pr | 140.9 | 6.773 | 931 | 3512 |
| $PrCl_3$ | 247.27 | 4.02 | 786 | 1700 |
| Sm | 150.35 | 7.52 | 1077 | 1791 |
| $SmCl_3$ | 256.71 | 4.46 | 678 | — |
| Ca | 40.08 | 1.55 | 850 | 1494 |
| CaO | 56.08 | 3.25 | 2927 | 3500 |
| Na | 22.99 | 0.968 | 97.82 | 881 |
| K | 39.10 | 0.86 | 63.65 | 774 |
| Fe | 55.85 | 7.86 | 1537 | 2872 |
| Zn | 65.37 | 7.14 | 419.6 | 911 |
| $CaCl_2$ | 110.99 | 2.15 | 772 | 1940 |
| KCl | 74.56 | 1.98 | 770 | 1500** |
| NaCl | 58.45 | 2.164 | 801 | 1465 |
| 55 m/o $CaCl_2$—45 m/o NaCl | | 1.903* | | |
| NaCl | | 1.596* | | |
| $CaCl_2$ | | 2.104* | | |

*Calculated at 727° C.
**Sublimation

FIG. 1 shows a furnace well 2 having an inside diameter of 12.7 cm and a depth of 54.6 cm mounted to the floor 4 of a dry box with bolts 6. A non-oxidizing or reducing atmosphere containing less than one part per million each $O_2$, $N_2$ and $H_2O$ is preferably maintained in the box during operation.

The furnace is heated by means of three tubular, electric, clamshell heating elements 8, 10 and 12 having an inside diameter of 13.3 cm and a total length of 45.7 cm. The side and bottom of the furnace well are surrounded with refractory insulation 14. Thermocouples 15 are mounted on the outer wall 16 of furnace well 20 at various locations along its length. One of the centrally located thermocouples is used in conjunction with a proportional band temperature controller (not shown) to automatically control center clamshell heater 10. The other three thermocouples are monitored with a digital temperature readout system and top and bottom clamshell heaters 8 and 12 are manually controlled with transformers to maintain a fairly uniform temperature throughout the furnace.

Reduction reactions may be carried out in a reaction vessel 22 retained in stainless steel crucible 18. The vessel of FIG. 1 has a 10.2 cm outer diameter, is 12.7 cm deep and 0.15 cm thick. It is retained in stainless steel furnace well 20. Reaction vessel 22 is preferably made of tantalum metal when it is desired to remove the products from the vessel after they have cooled.

A tantalum stirrer 24 may be used to agitate the melt during the reduction process. The stirrer shown has a shaft 48.32 cm long and a welded blade 26. The stirrer is powered by a 100 W variable speed motor 28 capable of operating at speeds up to 700 revolutions per minute. The motor is mounted on a bracket 30 so that the depth of the stirrer blade in the reaction vessel can be adjusted. The shaft is journaled in a bushing 32 carried in an annular support bracket 34. The bracket is retained by collar 35 to which furnace well 20 is fastened by bolts 37. Chill water coils 36 are located near the top of well 20 to promote condensation and prevent escape of volatile reaction constituents. Cone shaped stainless steel baffles 38 are used to reflux vapors, and prevent the escape of reactive metals. Reflux products drop through tube 40 on bottom baffle 42.

When the constituents in the furnace are not stirred, they separate into layers with the rare earth in the collection pool 43 on the bottom, the chloride salt bath 44 above that and any unreacted reactive metal 45 above that.

Figure 2:
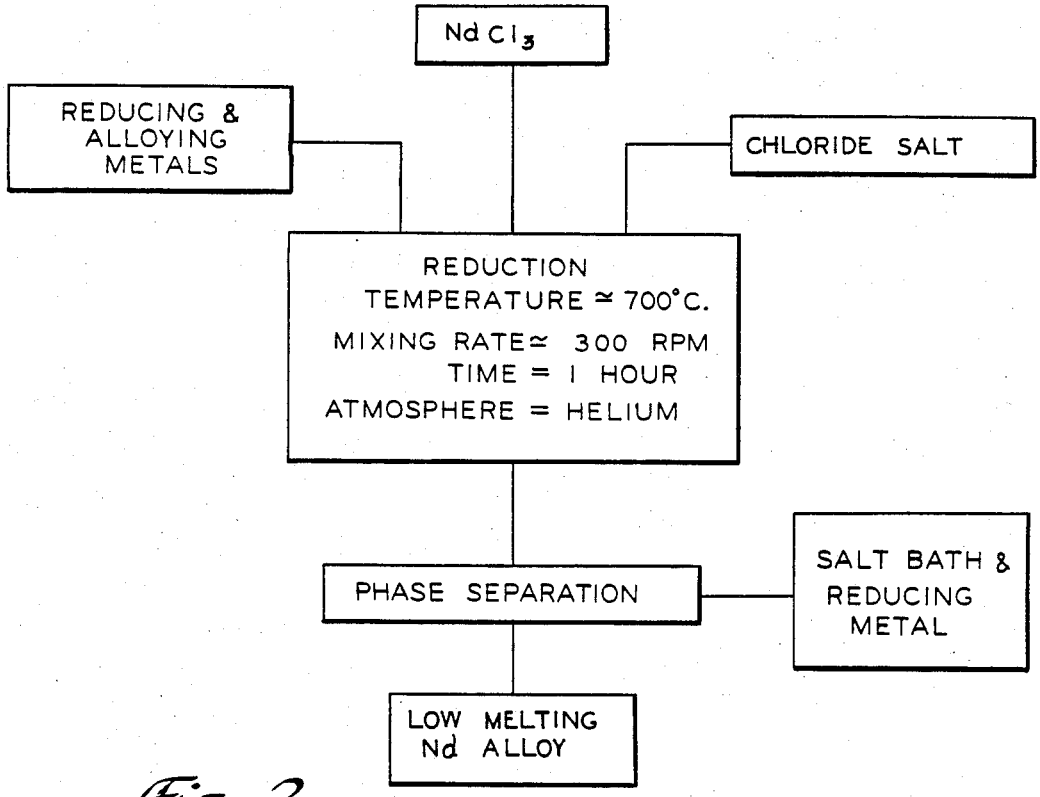
FIG. 2 is a flow chart for the reduction of $NdCl_3$ to yield a low melting neodymium alloy.

FIG. 2 is an idealized flow chart for the reduction of $NdCl_3$ to Nd metal in accordance with this invention. The $NdCl_3$ is added to the reaction vessel along with a stoichiometric excess of reducing metal, preferably sodium and/or calcium. Enough of a eutectic forming metal such as iron and/or zinc is added to form a near eutectic Nd alloy. The reduction reaction is fairly insensitive to the ratio of Group I or II salts in the bath composition; that is, yields greater than 90 percent can be obtained. However, the volume of RE chloride to be reduced should be less than the volume of molten salt.

Figure 3:
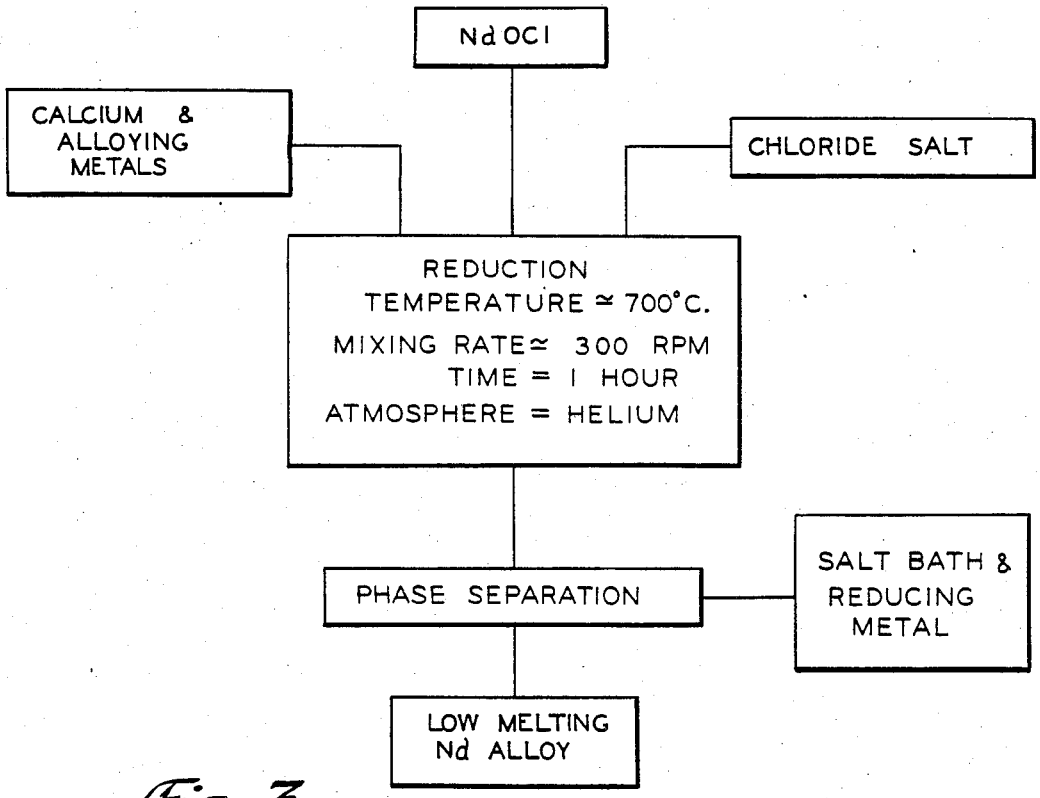
FIG. 3 is a flow chart for the reduction of NdOCl with calcium to yield a low melting neodymium alloy.

FIG. 3 is an idealized flow chart for the reduction of NdOCl to Nd metal in accordance with this invention. The NdOCl is added to the reaction vessel along with a stoichiometric excess of calcium metal. Yield in this reaction is also fairly insensitive to the chloride salt bath composition.

Figure 4:
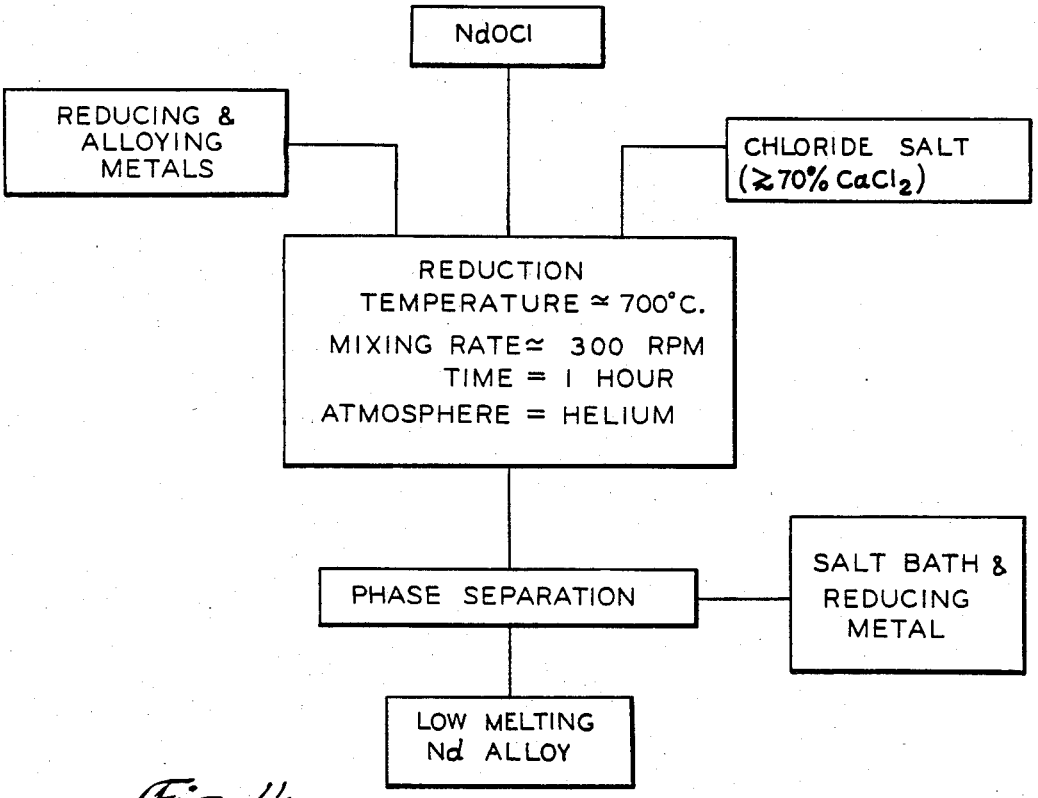
FIG. 4 is a flow chart for the reduction of NdOCl with Na and/or K to yield a low melting neodymium alloy.

FIG. 4 is an idealized flow chart for the reduction of NdOCl with Group I elements, particularly Na. Since Na does not directly reduce RE oxychlorides, it must first react with the salt bath constituents to form calcium metal in accordance with the reaction $$2Na + CaCl_2 \rightarrow Ca + 2NaCl.$$

In order for this reaction to have favorable equilibrium for the production of calcium, the salt bath should comprise at least about 70 percent by weight $CaCl_2$ based on the total chloride salt present.

The reactions are run with rapid stirring at about 600 revolutions per minute for one hour followed by slow stirring at about 60 revolutions per minute for another hour. Preferably, a blanket of an inert gas such as helium is maintained over the reaction vessel.

After substantially all the $NdCl_3$ or NdOCl has been reduced, slow stirring at about 60 revolutions per minute is continued to allow the rare earth metal to settle. Stirring is then stopped and the constituents are maintained at a suitable elevated temperature to allow the various liquids in the vessel to stratify. The reduced Nd eutectic alloy collects at the bottom because it has the highest density. The remaining salts and any unreacted reducing metal collects above the Nd alloy and can be readily broken away after the vessel has cooled and the constituents have solidified.

Nd alloys so produced can be alloyed with additional elements to produce permanent magnet compositions. These magnet alloys may be processed by melt-spinning or they can be ground and processed by the techniques conventionally employed to make samarium cobalt magnets.

While the invention has been described in detail for the reduction of $NdCl_3$ or NdOCl, it has equal applicability to reducing other single rare earth element chlorides or combinations of rare earth chlorides. This is due to the fact that Group I and II chlorides are more stable than the chlorides of any of the rare earths and CaO is more stable than RE oxides. While one skilled in the art could have made a determination of the relative free energies of RE-chlorides and Group I and II metal chlorides in the past, before this invention it was not known that RE-chlorides could be efficiently and cleanly reduced by Group I or II metals in a non-electrolytic, liquid phase process. Using the teachings of U.S. Pat. No. 4,578,242 along with those herein, one skilled in the art could concurrently reduce mixtures of RE oxides and RE chlorides. Oxides or chlorides of transition metals such as Fe and Co can be co-reduced with RE-chlorides by the subject process if desired.

In summary, I have developed a new and less costly method of reducing rare earth chlorides to high purity rare earth metals that is more than 90 percent efficient. It entails the formation of a suitable, molten metal-chloride based bath in which rare earth chloride is stirred with a stoichiometric excess of a reducing metal such as Na and/or Ca. RE oxychlorides may be reduced directly by Ca metal dispersed in a metal salt bath or by Na in a metal salt bath containing at least 70 weight percent $CaCl_2$.

When the reaction is completed and agitation is stopped, the components settle into discrete layers which can be easily separated when they cool and solidify. In the alternative, the reduced rare earth metal can be tapped from the bottom of the reaction vessel while molten. After molten metal is tapped, the bath can be refortified to run another batch making the process a substantially continuous one.

While my invention has been described in terms of specific embodiments thereof, other forms may be readily adapted by those skilled in the art. Accordingly, the scope of the invention is to be limited only by the following claims.

The embodiments of the invention in which an exclusive property or privilege is claimed are defined as follows:

1. A metallothermic method of reducing rare earth chloride and/or oxychloride feedstock to rare earth metal comprising forming a molten bath of Group I or Group II element chloride salts in a reaction vessel; forming a molten metal collection pool having a higher specific gravity than the chloride salt in the vessel; adding a volume of rare earth feedstock less than the volume of said chloride salt bath to the vessel; adding a stoichiometric excess of calcium metal based on said rare earth thereto; agitating the constituents in the vessel such that the rare earth feedstock is reduced to rare earth metal; and allowing the reactions constituents to settle into separate layers respectively containing any excess calcium metal, the chloride salt, and the reduced rare earth metal in the molten metal collection pool.

2. A metallothermic method of reducing rare earth chloride to rare earth metal comprising forming a molten salt bath comprised of calcium chloride in a reaction vessel; forming a molten metal collection pool in the vessel; adding a volume of rare earth chloride less than the volume of the salt bath to said vessel; adding an amount of sodium and/or calcium to said bath sufficient to form a stoichiometric excess of calcium metal based on the amount of rare earth chloride therein by the reaction;

$$CaCl_2 + 2Na \rightarrow Ca + 2NaCl$$

and maintaining said bath in a molten state and agitating it such that the calcium metal reduces the rare earth chloride to rare earth metal.

3. A metallothermic method of reducing neodymium chloride to neodymium metal comprising forming a molten salt bath comprised of calcium chloride; forming a molten rare earth-iron pool in the vessel; adding a volume of neodymium chloride less than the volume of said bath to said bath; adding an amount of one or more reactive metals taken from the group consisting of sodium and calcium to said bath sufficient to form a stoichiometric excess of calcium metal based on the amount of rare earth chloride therein; and maintaining said bath in a molten state and agitating it such that the calcium metal reduces the neodymium chloride to neodymium metal, and collecting the reduced neodymium in the rare earth-iron pool.

4. A metallothermic method of reducing rare earth chloride and/or oxychloride feedstock to rare earth metal comprising forming a molten salt bath comprised of at least about 70 weight percent calcium chloride; adding rare earth feedstock to said bath; adding an amount of one or more reactive metals taken from Groups I and II of the Periodic Chart to said bath sufficient to form a stoichiometric excess of calcium metal based on the amount of rare earth therein; maintaining said bath in a molten state and agitating it such that the calcium metal reduces the rare earth feedstock to rare earth metal; stopping agitation and collecting the rare earth metal in a molten metal pool located beneath the salt bath and any unreacted reactive metal.

5. The method of claim 4 wherein the rare earth is one or more taken from the group consisting of mischmetal, lanthanum, cerium, praseodymium and neodymium.

6. The method of claim 4 wherein the reactive metal is one or more taken form the group consisting of sodium and calcium.

7. A method of making an alloy of one or more rare earth elements and iron comprising forming a molten salt bath comprised of Group I and/or Group II chloride salts; adding feedstock of rare earth chloride and/or oxychloride having a volume less than the volume of said bath to said bath; adding an amount of one or more reactive metals taken from the group consisting of sodium and calcium to said bath sufficient to form a stoichiometric excess of reactive metal based on the amount of rare earth therein; maintaining said bath in a molten state and agitating it such that the reactive metal reduces the rare earth feedstock to rare earth metal; adding an amount of iron to said bath sufficient to form an iron-rare earth alloy having a melting temperature substantially lower than the melting temperature of the rare earth metal; and stopping agitation such that the rare earth metal-iron alloy collects in a discrete layer substantially free of oxygen, chloride and reactive metal.

8. The method of claim 7 wherein the rare earth is one or more taken from the group consisting of lanthanum, cerium, praseodymium and neodymium.

9. The method of claim 7 wherein the reactive metal is calcium.

10. The method of claim 7 wherein the salt bath comprises at least about 70 percent $CaCl_2$.

11. The method of claim 7 wherein the salt bath comprises one or more chlorides taken from the group consisting of sodium chloride, potassium chloride and calcium chloride.

12. A method of making a low-melting alloy of one or more rare earth elements and one or more non-rare earth metals comprising forming a molten salt bath comprised of Group I and/or Group II chloride salts; adding rare earth chloride and/or oxychloride feedstock to said bath; adding an amount of one or more reactive metals taken from Groups I and II of the Periodic Chart to said bath sufficient to form a stoichiometric excess of calcium metal based on the amount of rare earth therein; maintaining said bath in a molten state and agitating it until the feedstock is reduced to rare earth metal; adding an amount of non-rare earth metal to said bath sufficient to form a rare earth/non-rare earth metal alloy with a melting temperature substantially lower than the melting temperature of the rare earth metal; and stopping agitation thereby allowing the reaction constituents to settle into separate layers respectively containing any excess calcium metal, the chloride salt, and the reduced rare earth metal/non-rare earth metal such that the rare earth/non-rare earth metal alloy collects in a discrete layer substantially free of oxygen, chloride and reactive metal.

13. The method of claim 12 wherein the rare earth is one or more taken from the group consisting of mischmetal, lanthanum, cerium, praseodymium, and neodymium.

14. The method of claim 12 wherein the feedstock is neodymium chloride and/or neodymium oxychloride.

15. A metallothermic method of reducing feedstock of one or more rare earth chlorides and/or oxides to rare earth metal comprising agitating said feedstock in a bath of molten chloride salt having a volume greater than the volume of said feedstock, said bath containing a stoichiometric excess of calcium metal based on the rare earth in the feedstock, and thereafter stopping agitation such that the reduced rare earth metal, salt and any excess calcium collect in separate layers.

* * * * *